US007806645B2

(12) United States Patent
Arrez et al.

(10) Patent No.: US 7,806,645 B2
(45) Date of Patent: Oct. 5, 2010

(54) ADAPTABLE CART LIFTER

(75) Inventors: Ramiro Arrez, Orland Park, IL (US); Carlos Arrez, Berwyn, IL (US)

(73) Assignee: Perkins Manufacturing Company, Romeoville, IL (US)

( * ) Notice: Subject to any disclaimer, the term of this patent is extended or adjusted under 35 U.S.C. 154(b) by 890 days.

(21) Appl. No.: 11/673,005

(22) Filed: Feb. 9, 2007

(65) Prior Publication Data

US 2007/0183872 A1 Aug. 9, 2007

Related U.S. Application Data

(60) Provisional application No. 60/771,624, filed on Feb. 9, 2006.

(51) Int. Cl.
*B65F 3/02* (2006.01)

(52) U.S. Cl. ..... 414/408; 414/419

(58) Field of Classification Search ..... 414/425, 414/406, 408, 419–421, 410
See application file for complete search history.

(56) References Cited

U.S. PATENT DOCUMENTS

| | | | |
|---|---|---|---|
| 1,475,483 | A | 11/1923 | Galuska |
| 1,763,499 | A | 6/1930 | Bolger |
| 2,480,959 | A | 9/1949 | Presnell |
| 2,824,658 | A | 2/1958 | Beasley |
| 3,032,216 | A | 5/1962 | McCarthy |
| 3,040,919 | A | 6/1962 | Nolan |
| 3,136,436 | A | 6/1964 | Erlinder et al. |
| 3,147,870 | A | 9/1964 | Urban et al. |
| 3,170,580 | A | 2/1965 | Soyko |
| 3,211,312 | A | 10/1965 | Miller |
| 3,270,902 | A | 9/1966 | Breault |
| 3,279,633 | A | 10/1966 | Evers |
| 3,327,876 | A | 6/1967 | Kolling |
| 3,415,169 | A | 12/1968 | Naddell |
| 3,516,562 | A | 6/1970 | Knight |
| 3,576,215 | A | 4/1971 | Cline |
| 3,576,265 | A | 4/1971 | Brady et al. |

(Continued)

FOREIGN PATENT DOCUMENTS

| | | |
|---|---|---|
| AT | 243183 | 10/1965 |

(Continued)

OTHER PUBLICATIONS

Bayne Brochure Thinline® Grabber Lifter, Model GTLS 1110, undated, (2 pages).

(Continued)

*Primary Examiner*—Saúl J Rodríguez
*Assistant Examiner*—Joshua I Rudawitz
(74) *Attorney, Agent, or Firm*—Cook Alex Ltd.

(57) ABSTRACT

A refuse collection cart lifter is provided with a lock/release mechanism that prevents relative movement between the upper and lower hooks when the lifter is in the inverted position, but permits such relative movement when released so as to permit the lifter to have a an adaptable or "breakaway" feature This allows the lifter to be mounted on vertical surfaces that may prevent the lifter from retracting to a recessed position when in the lowered or retracted position, but still permit the first actuator arms supporting the lower hook to pivot freely with respect to the lift arms should an obstacle be engaged.

3 Claims, 5 Drawing Sheets

U.S. PATENT DOCUMENTS

| | | | | |
|---|---|---|---|---|
| 3,662,910 | A | | 5/1972 | Herpich et al. |
| 3,702,662 | A | * | 11/1972 | Davieau ..... 414/303 |
| 3,730,365 | A | | 5/1973 | Herpich et al. |
| 3,732,997 | A | | 5/1973 | Reavis et al. |
| 3,738,516 | A | | 6/1973 | Wells |
| 3,747,785 | A | | 7/1973 | Dahlin |
| 3,762,586 | A | | 10/1973 | Updike, Jr. |
| 3,773,197 | A | | 11/1973 | Blakeley et al. |
| 3,804,277 | A | | 4/1974 | Brown et al. |
| 3,822,802 | A | | 7/1974 | Evans, Jr. |
| 3,823,973 | A | | 7/1974 | Ramer |
| 3,837,512 | A | | 9/1974 | Brown |
| 3,841,508 | A | | 10/1974 | Ebeling et al. |
| 3,844,434 | A | | 10/1974 | Blakeley et al. |
| 3,861,547 | A | | 1/1975 | Sink, Sr. |
| 3,884,376 | A | | 5/1975 | Rivers |
| 3,894,642 | A | | 7/1975 | Shive |
| 3,901,255 | A | | 8/1975 | Pettit |
| 3,931,901 | A | | 1/1976 | Jones |
| 3,944,092 | A | | 3/1976 | Ebeling et al. |
| 3,954,194 | A | | 5/1976 | Stedman |
| 3,964,624 | A | | 6/1976 | Werder |
| 3,978,999 | A | | 9/1976 | Ryder |
| 4,042,137 | A | | 8/1977 | Hughes et al. |
| 4,057,156 | A | | 11/1977 | Thompson et al. |
| 4,090,626 | A | | 5/1978 | Ebeling et al. |
| 4,091,944 | A | | 5/1978 | Gollnick |
| 4,096,959 | A | | 6/1978 | Schaffler |
| 4,113,125 | A | | 9/1978 | Schiller |
| 4,175,903 | A | | 11/1979 | Carson |
| 4,219,298 | A | | 8/1980 | Stragier et al. |
| 4,227,849 | A | | 10/1980 | Worthington |
| 4,230,359 | A | | 10/1980 | Smith |
| 4,237,857 | A | | 12/1980 | Sharp, Sr. |
| 4,295,776 | A | | 10/1981 | Payne et al. |
| 4,313,707 | A | | 2/1982 | Bingman et al. |
| 4,345,868 | A | | 8/1982 | Rizzo et al. |
| 4,348,147 | A | | 9/1982 | Helm |
| 4,363,588 | A | | 12/1982 | Stickney |
| 4,365,922 | A | | 12/1982 | Borders |
| 4,372,726 | A | | 2/1983 | Lutz |
| 4,401,407 | A | | 8/1983 | Breckenridge |
| 4,422,814 | A | | 12/1983 | Borders |
| 4,427,333 | A | | 1/1984 | Ebeling |
| 4,435,117 | A | | 3/1984 | House |
| 4,450,828 | A | | 5/1984 | Onken et al. |
| 4,461,607 | A | | 7/1984 | Smith |
| 4,461,608 | A | | 7/1984 | Boda |
| 4,479,751 | A | | 10/1984 | Wyman et al. |
| 4,527,939 | A | | 7/1985 | Suarez |
| 4,538,951 | A | | 9/1985 | Yeazel et al. |
| 4,543,028 | A | | 9/1985 | Bell et al. |
| 4,548,542 | A | | 10/1985 | Reese |
| 4,557,658 | A | | 12/1985 | Lutz |
| 4,566,840 | A | | 1/1986 | Smith |
| 4,575,300 | A | | 3/1986 | George |
| 4,597,710 | A | | 7/1986 | Kovats |
| 4,597,712 | A | | 7/1986 | Smith |
| 4,613,271 | A | | 9/1986 | Naab |
| 4,669,940 | A | | 6/1987 | Engelhardt et al. |
| 4,673,327 | A | | 6/1987 | Knapp |
| 4,687,405 | A | | 8/1987 | Olney |
| 4,699,557 | A | | 10/1987 | Barnes |
| 4,708,570 | A | | 11/1987 | Smith et al. |
| 4,715,767 | A | | 12/1987 | Edelhoff et al. |
| 4,722,658 | A | | 2/1988 | Wurtz et al. |
| 4,726,726 | A | | 2/1988 | Dossena et al. |
| 4,741,658 | A | | 5/1988 | Zelinka et al. |
| 4,773,812 | A | | 9/1988 | Bayne et al. |
| 4,844,682 | A | | 7/1989 | Edelhoff |
| 4,872,801 | A | | 10/1989 | Yeazel et al. |
| 4,909,564 | A | | 3/1990 | Pfeifer et al. |
| 4,911,600 | A | | 3/1990 | Zelinka et al. |
| 4,936,732 | A | | 6/1990 | Naab et al. |
| 4,966,514 | A | | 10/1990 | Knapp |
| 4,983,092 | A | * | 1/1991 | Richards ..... 414/408 |
| 4,992,018 | A | | 2/1991 | Prout et al. |
| 5,002,450 | A | | 3/1991 | Naab |
| 5,007,786 | A | | 4/1991 | Bingman |
| 5,015,142 | A | | 5/1991 | Carson |
| 5,015,143 | A | | 5/1991 | Carson |
| 5,018,929 | A | | 5/1991 | Carson |
| 5,024,573 | A | | 6/1991 | Redding et al. |
| 5,026,104 | A | | 6/1991 | Pickrell |
| 5,026,241 | A | * | 6/1991 | Wyman ..... 414/303 |
| 5,028,196 | A | | 7/1991 | Richards |
| 5,035,563 | A | | 7/1991 | Mezey |
| 5,049,026 | A | | 9/1991 | Bingman et al. |
| 5,056,979 | A | | 10/1991 | Niederer et al. |
| 5,069,593 | A | | 12/1991 | Zelinka et al. |
| 5,071,303 | A | | 12/1991 | Carson |
| 5,071,307 | A | | 12/1991 | Carson |
| 5,092,731 | A | | 3/1992 | Jones et al. |
| 5,098,250 | A | | 3/1992 | Carson |
| 5,114,304 | A | | 5/1992 | Edelhoff et al. |
| 5,163,805 | A | | 11/1992 | Mezey |
| 5,205,698 | A | | 4/1993 | Mezey |
| 5,209,537 | A | | 5/1993 | Smith et al. |
| 5,230,393 | A | | 7/1993 | Mezey |
| 5,257,877 | A | | 11/1993 | Zelinka et al. |
| 5,266,000 | A | | 11/1993 | LeBlanc, Jr. |
| 5,303,841 | A | | 4/1994 | Mezey |
| 5,308,211 | A | * | 5/1994 | Bayne ..... 414/408 |
| 5,333,984 | A | | 8/1994 | Bayne et al. |
| 5,344,272 | A | | 9/1994 | Nuyts |
| 5,360,310 | A | | 11/1994 | Jones et al. |
| 5,391,039 | A | | 2/1995 | Holtom |
| 5,466,110 | A | | 11/1995 | Redding |
| 5,470,187 | A | | 11/1995 | Smith et al. |
| 5,482,180 | A | | 1/1996 | Smith et al. |
| 5,484,245 | A | | 1/1996 | Zopf |
| 5,505,576 | A | | 4/1996 | Sizemore et al. |
| 5,513,942 | A | | 5/1996 | Pickrell |
| 5,551,824 | A | | 9/1996 | Zanzig et al. |
| 5,562,386 | A | | 10/1996 | Browning |
| 5,601,392 | A | | 2/1997 | Smith et al. |
| 5,607,277 | A | | 3/1997 | Zopf |
| 5,639,201 | A | | 6/1997 | Curotto |
| 5,720,588 | A | | 2/1998 | Graves |
| 5,720,589 | A | | 2/1998 | Christenson et al. |
| 5,755,547 | A | | 5/1998 | Flerchinger et al. |
| 5,769,592 | A | | 6/1998 | Christenson |
| 5,775,867 | A | | 7/1998 | Christenson |
| 5,791,861 | A | | 8/1998 | Seelig |
| 5,797,715 | A | | 8/1998 | Christenson |
| 5,807,056 | A | | 9/1998 | Osborn et al. |
| 5,813,824 | A | | 9/1998 | Zanzig et al. |
| 5,829,944 | A | | 11/1998 | Szinte |
| 5,833,428 | A | | 11/1998 | Szinte |
| 5,853,277 | A | | 12/1998 | Everhart |
| 5,890,865 | A | | 4/1999 | Smith et al. |
| 6,059,511 | A | | 5/2000 | Anderson et al. |
| 6,095,744 | A | | 8/2000 | Harrison |
| 6,139,244 | A | | 10/2000 | VanRaden |
| 6,158,945 | A | | 12/2000 | Anderson et al. |
| 6,167,795 | B1 | | 1/2001 | Bayne et al. |
| 6,183,185 | B1 | | 2/2001 | Zanzig et al. |
| 6,224,317 | B1 | * | 5/2001 | Kann et al. ..... 414/408 |
| 6,293,863 | B1 | | 9/2001 | Carr et al. |
| 6,325,587 | B1 | | 12/2001 | Wysocki et al. |
| 6,357,988 | B1 | | 3/2002 | Bayne |
| 6,413,031 | B1 | | 7/2002 | Yakley et al. |
| 6,439,667 | B1 | | 8/2002 | Weets et al. |
| 6,503,045 | B2 | * | 1/2003 | Arrez et al. ..... 414/408 |

| | | | | |
|---|---|---|---|---|
| 6,551,046 | B1 * | 4/2003 | Dorrington | 414/408 |
| 6,921,239 | B2 * | 7/2005 | Arrez et al. | 414/408 |
| 6,988,864 | B2 * | 1/2006 | Arrez et al. | 414/406 |
| 7,273,340 | B2 * | 9/2007 | Arrez et al. | 414/421 |
| 7,390,159 | B2 * | 6/2008 | Rimsa et al. | 414/408 |
| 2001/0046430 | A1 | 11/2001 | Bayne | |
| 2002/0071748 | A1 * | 6/2002 | Arrez et al. | 414/408 |
| 2002/0119034 | A1 * | 8/2002 | Arrez et al. | 414/408 |
| 2002/0141854 | A1 | 10/2002 | Arrez et al. | |
| 2002/0141855 | A1 | 10/2002 | Arrez et al. | |
| 2003/0099529 | A1 | 5/2003 | Arrez et al. | |
| 2005/0095096 | A1 | 5/2005 | Curotto et al. | |
| 2005/0095097 | A1 | 5/2005 | Arrez et al. | |
| 2005/0111942 | A1 | 5/2005 | Rimsa et al. | |

FOREIGN PATENT DOCUMENTS

| | | |
|---|---|---|
| BE | 510235 | 4/1952 |
| CA | 622499 | 6/1961 |
| CH | 358747 | 11/1961 |
| CH | 453203 | 6/1968 |
| DE | 811 456 | 8/1951 |
| DE | 844 262 | 7/1952 |
| DE | 1 226 035 | 9/1966 |
| DE | 1 236 403 | 3/1967 |
| DE | 1 531 763 | 1/1970 |
| DE | 2 051 270 | 4/1971 |
| DE | 2 146 653 | 3/1973 |
| DE | 30 24 081 | 1/1981 |
| DK | 82300 | 3/1957 |
| EP | 0 078 011 | 5/1983 |
| EP | 0 312 900 | 4/1989 |
| EP | 0 405 428 | 1/1991 |
| EP | 0 575 867 | 12/1993 |
| FR | 2 272 002 | 12/1975 |
| FR | 2 459 779 | 1/1981 |
| FR | 2 479 783 | 10/1981 |
| FR | 2 500 425 | 8/1982 |
| GB | 291709 | 6/1928 |
| GB | 2 078 196 | 1/1982 |
| GB | 2 080 757 | 2/1982 |
| GB | 2 188 302 | 9/1987 |
| SU | 751794 | 7/1980 |
| SU | 1253892 | 8/1986 |
| WO | WO 83/03242 | 9/1983 |
| WO | WO 91/00231 | 1/1991 |
| WO | WO 91/05721 | 5/1991 |
| WO | WO 92/01612 | 2/1992 |
| WO | WO 93/25457 | 12/1993 |
| WO | WO 94/21540 | 9/1994 |

OTHER PUBLICATIONS

Lifting Mechanism for a Sanitation Vehicle, U.S. patent application Ser. No. 378,823, filed May 12, 1982, now abandoned (bearing production Nos. B984-1005), with photographs (dated Dec. 1981) (bearing production Nos. B1082-1097), photographs of a present.

McKagen, World Wastes, "Supercan! Can . . . And Does," Jun. 1983, pp. 24-26.

Perkins Mfg. Brochure: "The Original Rotary Tuckaway," Model D6080-20K, (2 pages).

Refuse Removal Systems, Inc., "Waste Wheeler," Waste Age, 1982 (with photographs of the device bearing production Nos. B913-922).

Rubbermaid "Mobile Toter."

Taskmaster Lifter features/specifications from: http://www.baynethinline.com/products-taskmaster.htm.

Waste Age, Mar. 1982, pp. 31-33.

Zarn Model "D" sales brochure, printed prior to Mar. 20, 2002.

Zöller-Kipper GMBH Brochure "Zöller System." (11 pages).

* cited by examiner

ADAPTABLE CART LIFTER

CROSS REFERENCE TO RELATED APPLICATION

This application claims the benefit of U.S. Provisional Application No. 60/771,624, filed Feb. 9, 2006.

BACKGROUND OF THE INVENTION

The present invention relates generally to lifters for mounting on refuse collection vehicles.

It is well known to employ refuse container lifters for automatically lifting and dumping large residential refuse collection containers or carts. Such lifters are typically mounted on the rear of refuse collection trucks, adjacent to the refuse hopper See U.S. Pat. Nos. 6,988,864, 6,921,239, 6,884,017, and 6,503,045, as well as published U.S. application number U.S. 2005/0169734, all of which are incorporated herein by reference.

The above-referenced patents and published application generally disclose refuse receptacle lifters that are movable between a retracted position and an inverted, dumping position for engaging, lifting and inverting refuse receptacles of the type including spaced-apart upper and lower lift surfaces, such as bars. The lift surfaces are typically located on or firmly secured to the container body in a recessed area to provide upper and lower engagement surfaces for engagement by the lifter.

Such lifters commonly include an actuator. In the referenced patents and published application, the actuator is a rotary hydraulic actuator. However, other types of actuators, such as piston-type or electric actuators, may also be used. The rotary actuator includes an output shaft that has a pair of lift arms mounted thereto The lift arms carry an upper hook for engaging the upper lift surface on the refuse container. A pair of actuator arms are pivotably mounted to the base and carry a face plate on their free ends having a lower hook associated therewith for engagement with the lower lift surface on the refuse receptacle Each of the lift arms has a second actuator arm pivotably connected thereto. Each lift arm is also connected for sliding engagement with its associated first actuator arm to effect movement of the lower hook in concert with the upper hook to engage, lift and invert the refuse container Specifically, upon rotation of the output shaft of the rotary actuator, the upper hook is moved into engagement with the upper lift surface of the refuse receptacle, the face plate moves into contact with the surface of the refuse receptacle, and the lower hook engages the lower lift surface of the receptacle lifter. As the output shaft continues to rotate, the refuse receptacle is lifted and inverted to dump its contents.

A commercially available lifter having the structure as described above is available from Perkins Manufacturing Company, of LaGrange, Ill., as the Model D 6400 "Tuck-Away" lifter.

SUMMARY OF THE INVENTION

In keeping with the present invention, a lifter is provided with a lock/release mechanism that prevents relative movement between the upper and lower hooks when the lifter is in the inverted position, but permits such relative movement when released so as to permit the lifter to have a an adaptable or "breakaway" feature. This allows the lifter to be mounted on vertical surfaces that may prevent the lifter from retracting to a recessed position when in the lowered or retracted position, but still permit the first actuator arms supporting the lower hook to pivot freely with respect to the lift arms should an obstacle be engaged.

In one aspect of the invention, a lifter for engaging, lifting and inverting a refuse collection cart is provided that comprises a base having an actuator secured thereto. At least one lift arm is operatively connected to the actuator that is moveable between a first, retracted position and a second, inverted dumping position. A first actuator arm is pivotably connected to the base while a second actuator arm operatively connects the lift arm to the first actuator arm. A lock is provided that engages the lift arm and the second actuator arm to prevent relative movement between them as the lift arm moves to the inverted dumping position. The lock releases the lift arm and second actuator arm to permit relative movement between the two as the lift arm moves to the retracted position.

Preferably, the lock is pivotably connected to the lift arm and is biased towards engagement with the first actuator arm when the first actuator arm is in the first, retracted position. In addition, the second actuator arm comprises a stub that, upon rotation of the second actuator arm with respect to the lift arm, forms a notch defined by the lift arm and the stub for receiving the lock.

In addition, the lock preferably comprises an elongated bar disposed in generally transverse relation to the first actuator arm. Hooks are associated with each of the lift arm and the first actuator arm for engaging the handles or other engagement surfaces of a refuse collection cart to secure it to the lifter for dumping,

DETAILED DESCRIPTION

Figure 1:
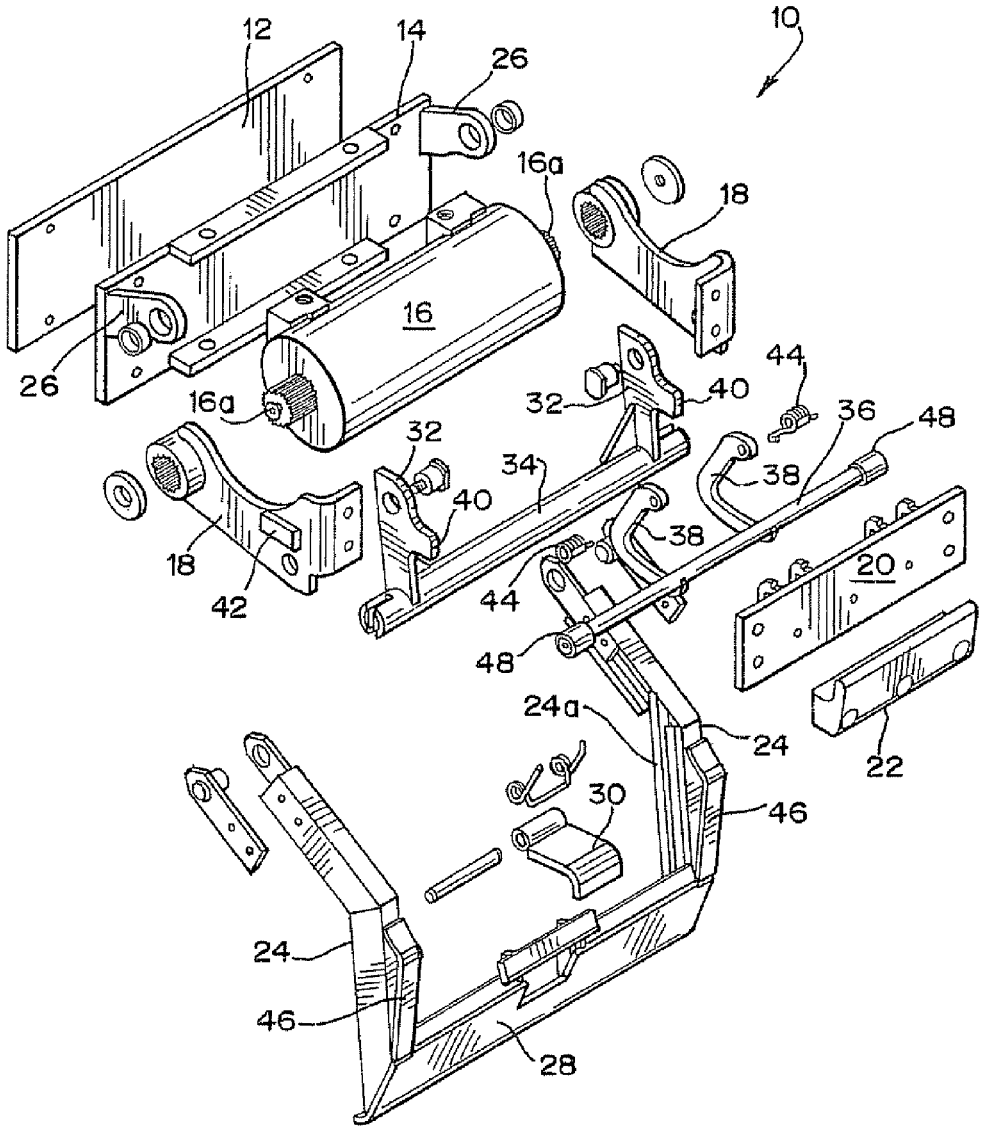
FIG. 1 is an exploded perspective view of a refuse collection cart lifter embodying the present invention.

Turning to the FIGS. 1-5 of the drawings, a lifter, generally designated 10, incorporating such a lock/release mechanism in accordance with the present invention is disclosed. The lifter includes a back mounting plate 12 that is typically secured to the sill of the hopper of a refuse collection vehicle (not shown) A base plate 14 is secured to the back mounting plate 12, and carries a rotary hydraulic actuator 16. The rotary actuator 16 includes an output shaft 16*a* that extends from both ends of the actuator. Each end of the output shaft 16*a* of the actuator 16 has a lift or drive arm 18 secured thereto Secured to the free ends of the lift/drive arms 18 is an upper hook bracket 20 that has an upper hook 22 fixed thereto The upper hook 22 is adapted to engage the upper lift bar of a refuse collection cart.

Each of a pair of first actuator arms 24 is pivotably mounted to a bracket 26, each bracket 26 being, in turn, secured to the base plate 14 by, e.g., welding The free ends of the first actuator arms 24 carry a face plate 28, to which a lower hook 30 is pivotably mounted for engagement with the lower lift bar of a refuse collection cart.

In order to pivot the first actuator arms 24 and the associated face plate 28 with respect to the base plate 14, a second actuator arm 32 is pivotably connected on its first end to each lift/drive arm 18 and is slidably connected on its second end to its respective first actuator arm 24 In the illustrated embodiment, the second ends of the second actuator arms 32 carry a transverse bar 34, the ends of which include a slot that receives a raised rib 24*a* on each of the first actuator arms 24 to facilitate sliding engagement. However, other slide connections may be utilized.

In accordance with one aspect of the invention, the lifter 10 is provided with a locking/release mechanism that prevents relative movement of the second actuator arms 32 with respect to the lift/drive arms 18 and the first actuator arms 24. This, in turn, causes the spacing between the upper hook 22 and lower hook 30 to be held constant as the lifter approaches and reaches the inverted position to ensure that the hooks remain engaged with their respective lift surfaces on the refuse cart. However, as the lifter moves away from the inverted position, the lock/release mechanism releases the second actuator arms 32 to permit relative movement of the first actuator arms 24 with respect to the lift/drive arms 18.

Figure 2:
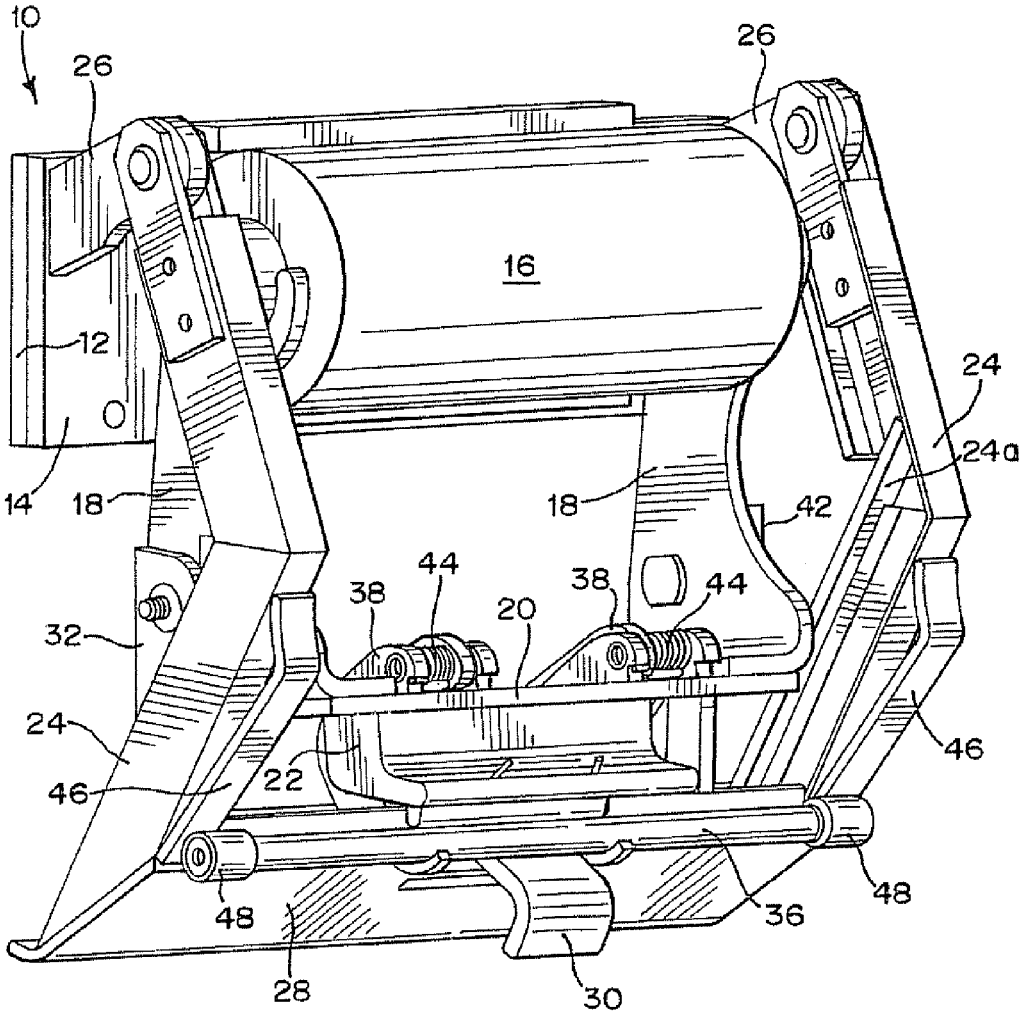
FIG. 2 is a perspective view of a refuse collection cart lifter according to the present invention with the lifter in its retracted position
Figure 3:
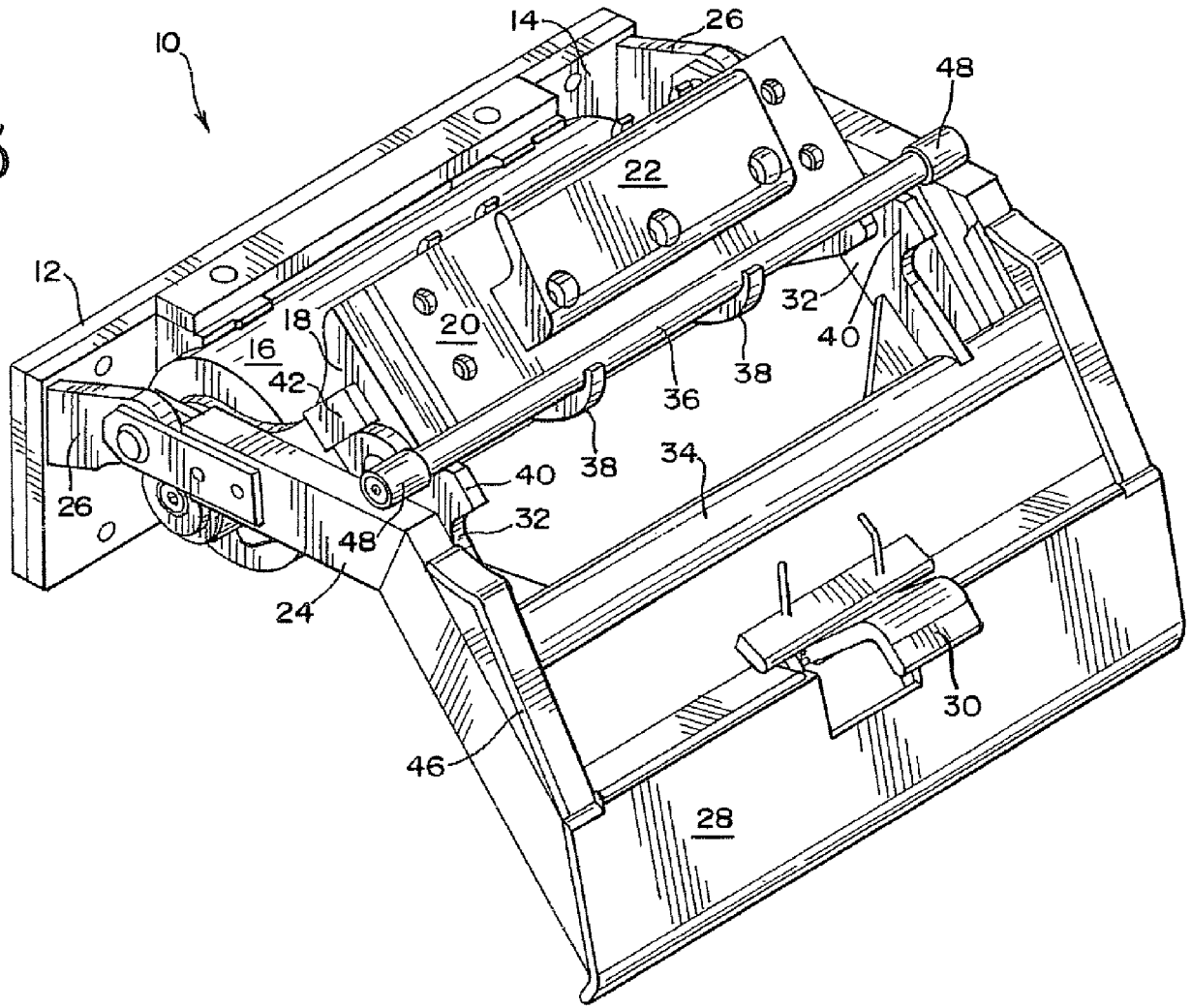
FIG. 3 is a perspective view of a refuse collection cart lifter according to the present invention with the lifter in a position intermediate its refracted and inverted dumping positions.
Figure 4:
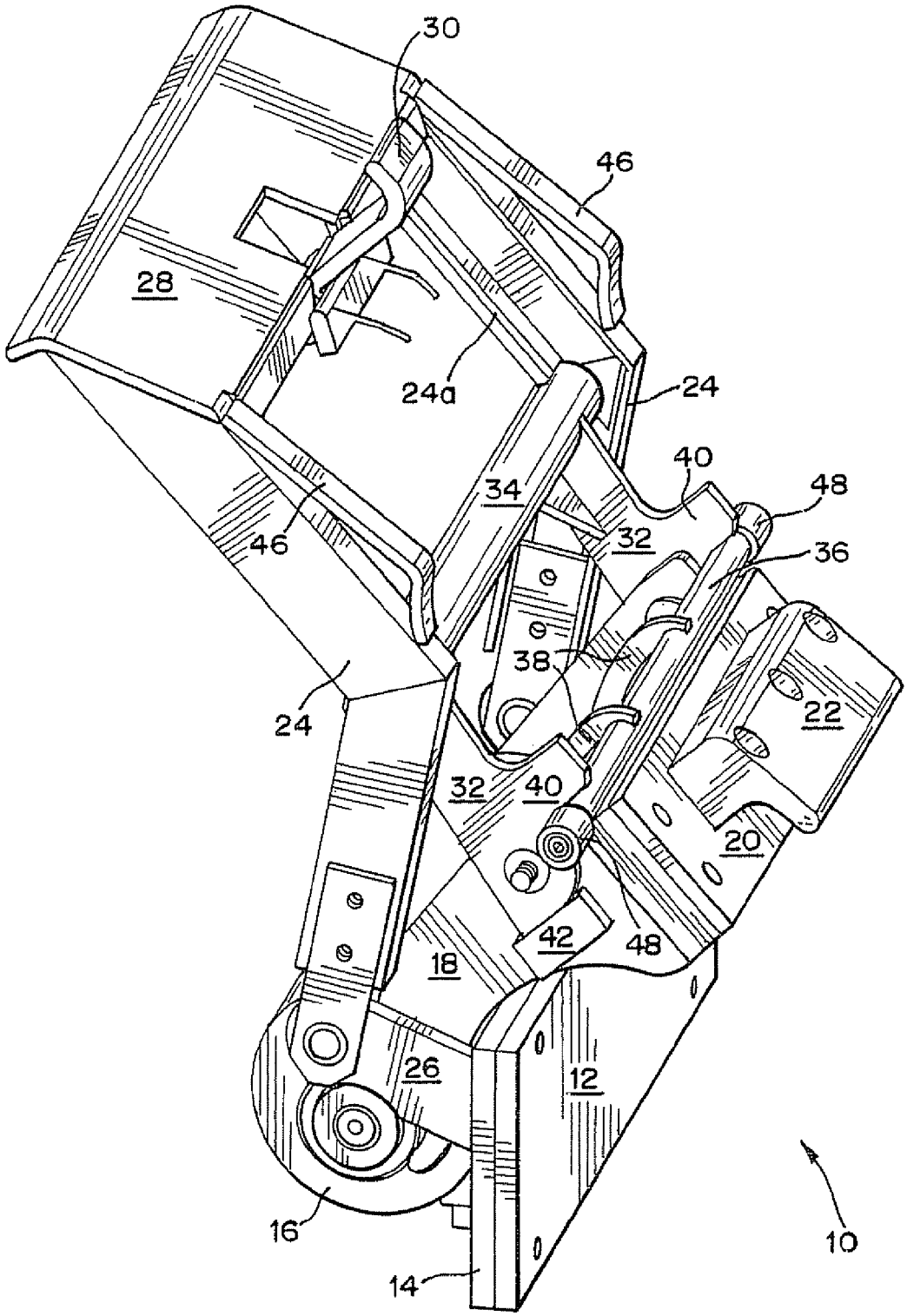
FIGS. 4 and 5 are perspective views of a refuse collection cart lifter according to the present invention with the lifter in its inverted/dumping position
Figure 5:
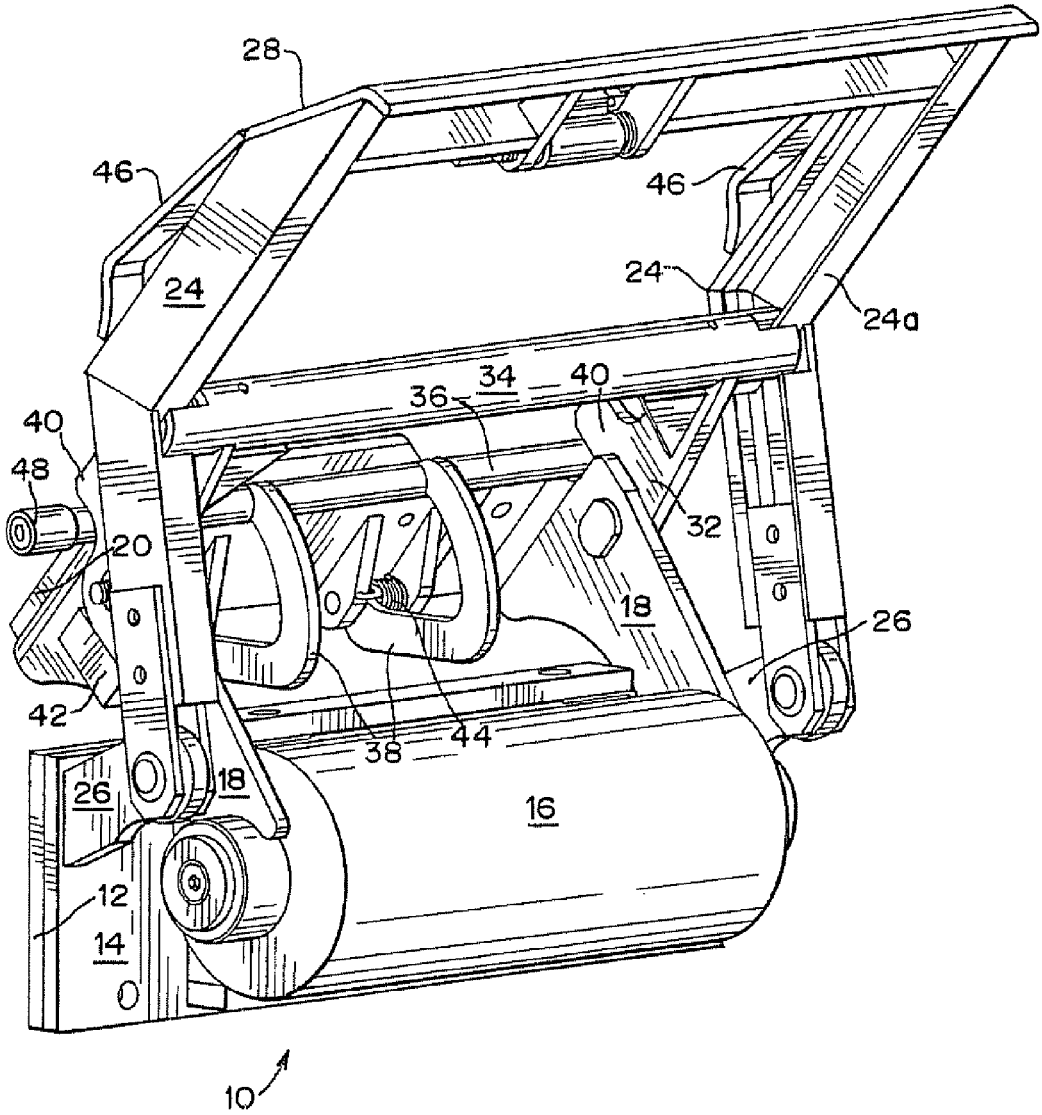

To this end, in the illustrated embodiment, a lock in the form of a locking/release bar 36 is provided that is pivotably connected to the upper hook bracket 20 by a pair of generally V-shaped arms 38. The locking/release bar 36 extends generally the width of the base plate 28 so as to engage a surface of each of the first actuator arms 24. As the lifter moves from its retracted position (as shown in FIG. 2) to an intermediate position (as shown in FIG. 3), the locking/release bar 36 moves along the surfaces of the first actuator arms until it comes into contact with the edge of the upper hook bracket 20. In this position, a stub or projecting surface 40 on each of the second actuator arms 32 is rotated so that it presents a notch or seat defined by the stub 40 and the lift arm 18 that receives the locking/release bar 36 (best seen in FIG. 4). When the locking/release bar 36 is received in the notch, further rotation of the second actuator arms 32 with respect to the lift arms 18 as the lifter continues towards the inverted position is prevented. The lift/drive arms 18 also include a stop 42 that helps to prevent rotation of the second actuator arms in a direction to release the locking/release bar 36 from the notch.

In the illustrated embodiments, the locking/release bar 36 is biased to pull the locking/release bar 36 into contact with the surface of the first actuator arms, by, e.g., coil springs 44, although other biasing means could be used. In addition, the first actuator arms 24 include a ramp 46 on which the ends of the locking/release bar ride to move the bar 36 toward and away from the notch. Preferably, the ends of the bar 36 include rollers 48, or other low friction surfaces, to facilitate its movement along the surface of the first actuator arms 24.

As the lifter 10 is lowered from the inverted position, the notches created by the stubs 40 on the second actuator arms 32 open, and the locking/release bar 36 is moved out of the notches as the rollers move along the ramps 46 on the first actuator arms 24. Once the bar 36 is released from the notch, the second actuator arms are free to "breakaway" from the lifter 10 in response to an external force.

Thus, a refuse container lifter has been provided that meets the objects of the present invention. While the lifter has been described in terms of a preferred embodiment, there is no intent to limit the invention to the same. Instead, the invention is defined by the scope of the following claims,

What is claimed:

1. A lifter for engaging, lifting and inverting a refuse collection cart comprising:

a base;

an actuator secured to the base;

at least one lift arm operatively connected to the actuator movable between a first retracted position and a second inverted dumping position;

a first actuator arm pivotably connected to the base;

a second actuator arm operatively connecting the lift arm to the first actuator arm; and a lock that that engages the lift arm and the second actuator arm to prevent relative movement between the lift arm and the second actuator arm as the lift arm moves to the inverted dumping position and releases the lift arm and second actuator arm to permit relative movement between the lift arm and the second actuator arm as the lift arm moves to the retracted position, the lock comprising an elongated bar disposed generally traversely to the first actuator arm and having an end that engages a surface of the first actuator arm when in the first retracted position, and the lock being pivotably connected to the lift arm and biased toward engagement with the first actuator arm when the first actuator arm is in the first retracted position.

2. The lifter of claim 1 wherein the second actuator arm comprises a stub that, upon rotation of the second actuator arm with respect to the lift arm, forms a notch defined by the lift arm and the stub that receives the lock.

3. The lifter of claim 1 further comprising a first hook associated with the lift arm and a second hook associated with the first actuator arm.

* * * * *